US005688567A

United States Patent [19]

Daulton

[11] Patent Number: 5,688,567

[45] Date of Patent: Nov. 18, 1997

[54] SEGMENTED SPHERICAL DISPLAY DEVICE FOR DISPLAYING VISIBLE INDICIA AND IMAGES

[76] Inventor: Jay S. Daulton, 2359 Meadowmont Dr., San Jose, Calif. 95133

[21] Appl. No.: 515,238

[22] Filed: Aug. 15, 1995

[51] Int. Cl.[6] ..... G09F 19/00

[52] U.S. Cl. ..... 428/11; 428/13; 428/67

[58] Field of Search ..... 428/11, 13, 67; 63/18; D11/80; 434/208

[56] References Cited

U.S. PATENT DOCUMENTS

| | | | |
|---|---|---|---|
| D. 135,964 | 7/1943 | De Aragon | D11/80 X |
| D. 327,031 | 6/1992 | Solomon et al. | D11/80 |
| 368,984 | 8/1887 | Vollmer | 63/18 |
| 2,450,620 | 10/1948 | Speicher | D11/80 X |
| 2,451,913 | 10/1948 | Brice | 428/13 X |
| 3,117,384 | 1/1964 | Bills | 434/208 |
| 4,809,417 | 3/1989 | Normann, Jr. | 428/67 X |
| 4,882,915 | 11/1989 | Porcaro | 63/18 X |
| 5,118,111 | 6/1992 | Suitor | 273/160 |

*Primary Examiner*—Henry F. Epstein
*Attorney, Agent, or Firm*—John J. Leavitt; George M. Cooper

[57] ABSTRACT

Presented is a segmented spherical display device including at least four embodiments. The segmented spherical body of the display device may be, but need not be, transparent, is segmented in specific ways unique to different segment configurations to provide multiple flat surface portions or facets, each defined by at least two straight edges or lines of demarcation and one arcuate edge subtending the angle defined by the two straight edges, and to which or on which facets may be detachably mounted selected visual indicia or images for visual display. In two of the embodiments, the segmented spherical bodies are each segmented to provide two bodies that are halves of a sphere, that are mirror-images of one another and interengageable to form a segmented sphere. In the other two embodiments, the respective spherical bodies are each segmented to provide four quarter-sphere segment portions or bodies that are mirror-images of one another. In each embodiment, the separate mirror-image segment bodies may be interengaged to complete a sphere, with each facet provided with indicia or an image to be displayed, or each independent segment body, with indicia or images mounted on its various facets, may be free-standing to enable direct viewing of the indicia or images mounted on the various facets.

60 Claims, 7 Drawing Sheets

10
11
12
13
14
15
16
17
18
41
42
43
44
46
47
48
49
51
52
53
54
56
57
58
59
61
62
63
64
66
71
72
73
74

SEGMENTED SPHERICAL DISPLAY DEVICE FOR DISPLAYING VISIBLE INDICIA AND IMAGES

BACKGROUND OF THE INVENTION

1. Field of the Invention

This invention relates to an article of manufacture comprising a segmented spherical body of transparent or non-transparent material, and more particularly to a segmented sphere formed from a plurality of interengageable segments each presenting a plurality of flat surfaces disposed within a spherically arcuate periphery and on which flat surfaces selected indicia and/or images may be mounted for visual display either directly or through the transparent spherically arcuate periphery of an individual segment body or segmented sphere as when the segments are interengaged.

2. Description of the Prior Art

A preliminary patentability and novelty search has revealed the existence of the following U.S. patents.

| | | |
|---|---|---|
| 368,984 | D-135,964 | 2,450,620 |
| 4,882,915 | D-327,031 | 5,118,111 |

There is a continuing desire by peoples of all nations to communicate with one another through the display of visible images, be they pictorial or textual indicia. In connection with this invention, the terms "indicia" and "images" are intended to mean any type of written or printed matter, and any type of pictorial matter, be it hand-executed, such as a drawing, or a photographic reproduction of any subject. Different modes for display of indicia and/or images have conventionally been used. Thus, very early in the development of mankind, pictographs were carved into rock, or painted on the surface of rocks or in caves. These of course are stationary displays and are limited to viewing by a relatively small number of persons having access to their location.

In more recent history, as mankind has become more mobile, there has arisen the desire, and the means, by which devices bearing visible indicia and/or images, again either pictorial or textual, could be transported from one location to another, enabling a more facile method of communicating such indicia and images to increasingly larger numbers of people. Examples of these types of devices include roadside billboards for viewing by motorists, lockets within which photographs may be mounted for selective display or not, photographic albums and picture frames.

Accordingly, one of the objects of the present invention is the provision of a spherical body, as an article of manufacture, either transparent or not, i.e., transparent or opaque, and which in either instance is segmented, i.e., divided into a plurality of separate mirror-image segments in such manner that each segment includes both a spherical surface portion and flat surfaces or facets on the latter of which indicia and/or images, either textual or pictorial or both, may be mounted for display either directly when the transparent or opaque segments stand independently from the other segments, i.e., alone, or visually through transparent peripheral portions when transparent segments are interengaged, i.e., arranged to form a transparent sphere.

Another object of the invention is the provision of a spherical body, either transparent or opaque, which is segmented, i.e., divided into a plurality of mirror-image segments, in such a manner that each segment includes two half-circle flat facets and two quarter-circle flat facets.

Yet another object of the invention is the provision of a spherical body, either transparent or opaque, which is segmented in such a manner as to provide a plurality of mirror-image segments each of which includes at least four quarter-circle flat facets.

A still further object of the invention is the provision of a spherical body which is segmented in such a manner as to produce a multiplicity of interengageable mirror-image segments which form the sphere when interengaged, each of which segments includes at least six flat facets adapted to abut or confront corresponding flat facets on adjacent segments.

A still further object of the invention is the provision of a segmented spherical body which is segmented in such a manner as to produce a plurality of segments each of which include a plurality of flat facets that are the mirror-image of corresponding flat facets on an associated segment whereby when said segments are interengaged to form a spherical body said flat facets of one segment lie confrontingly juxtaposed to the corresponding flat facets of an associated segment.

Yet another object of the invention is the provision, as an article of manufacture, of a body constituting a segment of a sphere including two half-circle flat facets perpendicular to one another, the median point of the diametric edge of one half-circle facet being coincident with the median point of the diametric edge of the other half-circle flat facet at the geometric center of the mass constituting the segment.

A still further object of the invention is the provision, as an article of manufacture, of a segment of a sphere including at least two quarter-circle flat facets in planar alignment and having their apexes that lie opposite the quarter-circle arcuate edge of the facets coincident with one another and with the geometric center of the mass constituting the segment.

While indicia and/or images to be displayed on the flat facets of a segmented sphere may be attached directly to such facets, as with an appropriate adhesive, it is preferable to provide a frame on each or selected facets within which frame the indicia or image may be displayed and by which frame it is secured on the facet. Accordingly, another object of the present invention is the provision, as an article of manufacture, of a segmented sphere having mirror-image segments including a plurality of flat facets on the peripheral surface of each of which, or selected ones thereof, there is mounted a frame for detachably retaining a support member bearing the indicia and/or image, either textual or pictorial.

Another object of the invention is the provision, as an article of manufacture, of a sphere segmented in such a manner that the separate segments may be interengaged to form a complete sphere of such size as to function as a spherical pendant to be worn about the neck, and within which may be mounted for selective display selected visual indicia or images, or which segmented spherical body may be separated into its separate segments for direct visual display of selected indicia or images while the separated segments are pendent or resting on a support surface.

The invention possesses other objects and features of advantage, some of which, with the foregoing, will be apparent from the following description and the drawings. It is to be understood however that the invention is not limited to the embodiments illustrated and described, since it may be embodied in various forms within the scope of the appended claims.

SUMMARY OF THE INVENTION

In terms of broad inclusion, the segmented spherical display device of my invention includes at least four preferred embodiments as illustrated in FIGS. 1–2, 8–9, 19–20 and 21–23. As there shown, in one aspect of the inventory, each embodiment comprises a spherical body which selectively may be, but need not be, transparent, and which is segmented in a specific manner unique to each embodiment to provide multiple flat surface portions or facets, each defined by at least two straight edges or lines of demarcation and one arcuate edge subtending the angle defined by the two straight edges, and to which or on which facets are mounted selected visual indicia or images for visual display. Visual display may occur directly on the facets of each separate segment prior to interengagement of the separate segments to form a sphere, or may occur through the transparent spherically arcuate surface associated with the facet on which the indicia or image is mounted.

In two of the embodiments illustrated (FIGS. 1–2 and 8–9), the segmented spherical bodies are each segmented to provide a plurality of segmented bodies, i.e., two halves of a sphere, that are mirror-images of one another and interengageable to form a sphere. In one of these two embodiments (FIGS. 1–2), each segment body is provided with two half-circle facets perpendicular to each other and two quarter-circle facets coincident with a common plane and perpendicular to the planes in which the two half-circle facets lie, one edge of each facet intercepting a spherically arcuate peripheral surface. In the other of these two embodiments (FIGS. 8–9), each segment body again constitutes one-half of a sphere and is provided with six quarter-circle facets one edge of each of which intercepts a spherically arcuate peripheral surface. Pairs of the quarter-circle facets are arranged in a common plane perpendicular to the planes common to the other pairs of quarter-circle facets.

In the other two preferred embodiments (FIGS. 19–20 and 21–23), the respective spherical bodies are each segmented to provide four quarter-sphere segment portions or bodies that are mirror-images of one another. In both of these two four-segment embodiments, each segment body is provided with four quarter-circle facets all of which lie in separate planes and each of which facets has two edges or lines of demarcation that intercept a spherically arcuate surface, and two less-than-quarter-circle facets that lie in a common plane and two edges or lines of demarction of each of which intercept a spherically arcuate surface. In each embodiment, the separate mirror-image segment bodies may be interengaged to complete a sphere, with each facet provided with indicia or an image to be displayed, or each independent segment body, with indicia or images mounted on its various facets, may be free-standing to enable direct viewing of the indicia or images mounted on the various facets.

DESCRIPTION OF THE PREFERRED EMBODIMENT

Figures 1, 2:
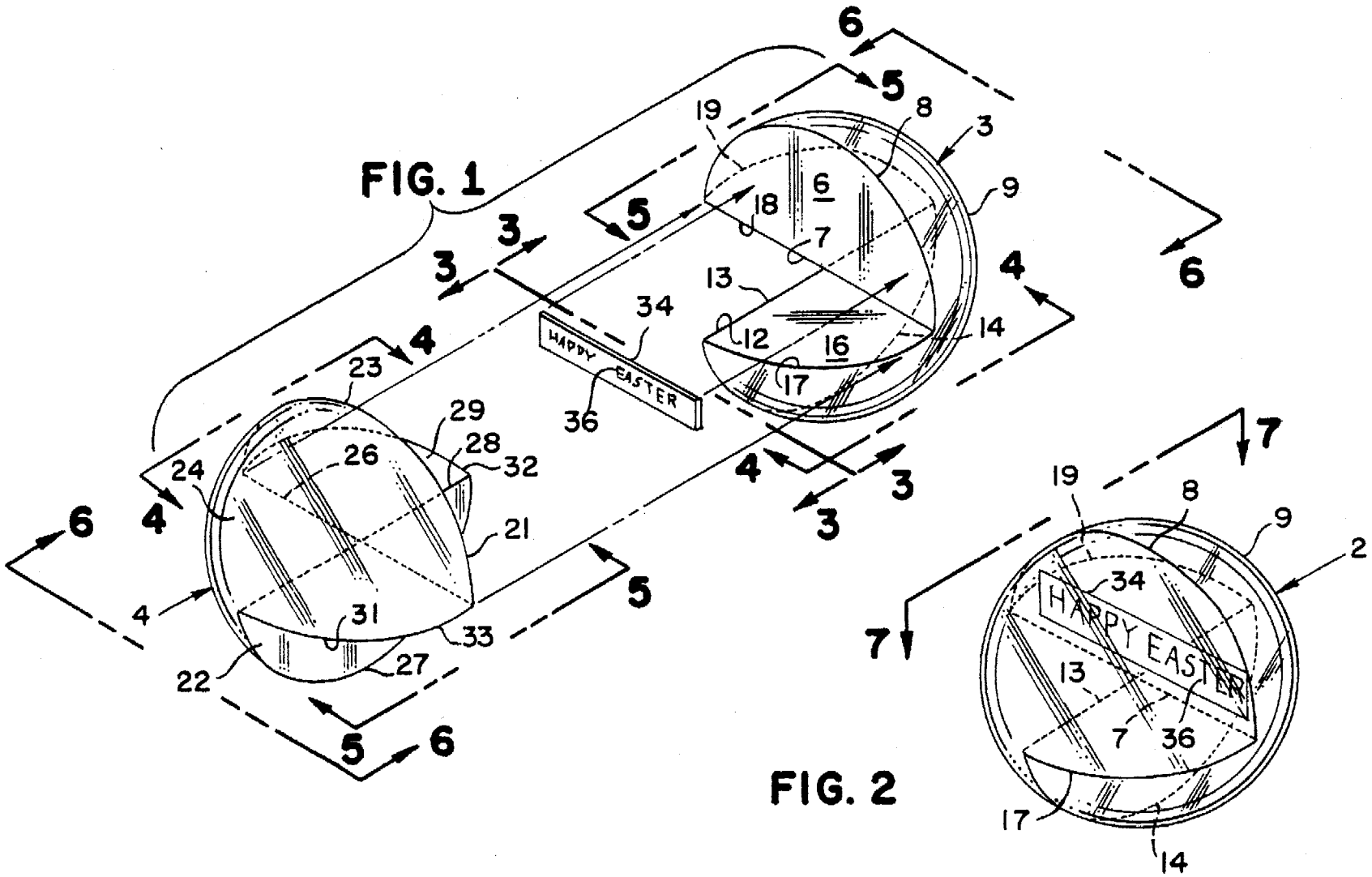
FIG. 1 is a perspective exploded view of a first preferred embodiment of my segmented spherical display device shown fabricated from transparent material, with the two transparent mirror-image segment bodies spaced apart to reveal various of the facets on which visual displays may be mounted.
FIG. 2 is a perspective view of the segmented transparent spherical display device of FIG. 1, shown with the two transparent mirror-image segment bodies interengaged to form a complete segmented sphere to enable viewing of the displays through the transparent spherical surfaces.
Figure 3:
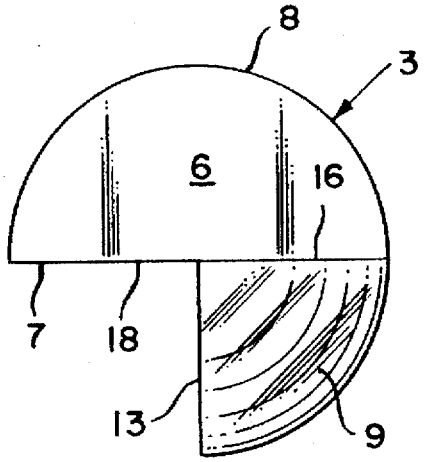
FIG. 3 is an elevational view illustrating the confronting facets of the two separated mirror-image segment bodies, taken in the direction of the arrows 3—3 in FIG. 1.
Figure 4:
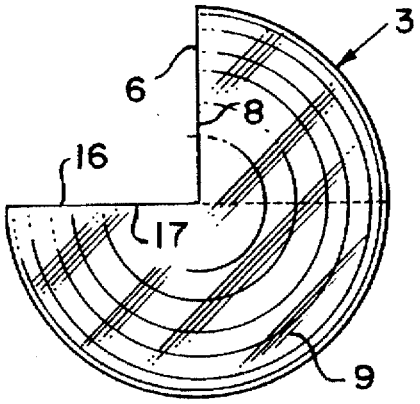
FIG. 4 is an elevational view illustrating the opposing sides of the two separated mirror-image segment bodies, taken in the direction of the arrows 4—4 associated with each segment body in FIG. 1.
Figure 5:
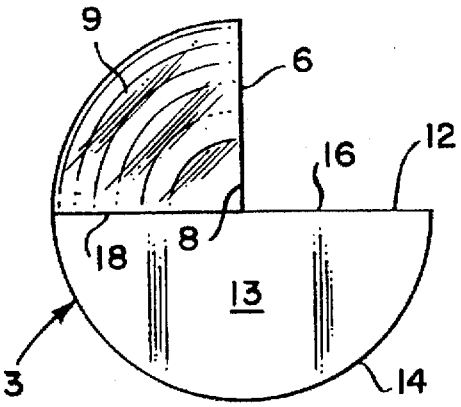
FIG. 5 is an elevational view illustrating opposing sides of the two separated mirror-image segment bodies, taken in the direction of the arrows 5—5 associated with each segment body in FIG. 1.
Figure 6:
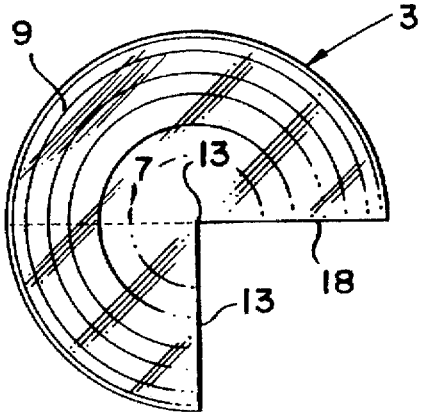
FIG. 6 is an elevational view illustrating opposing sides of the two separated mirror-image segment bodies, taken in the direction of the arrows 6—6 associated with each segment body in FIG. 1.
Figure 7:
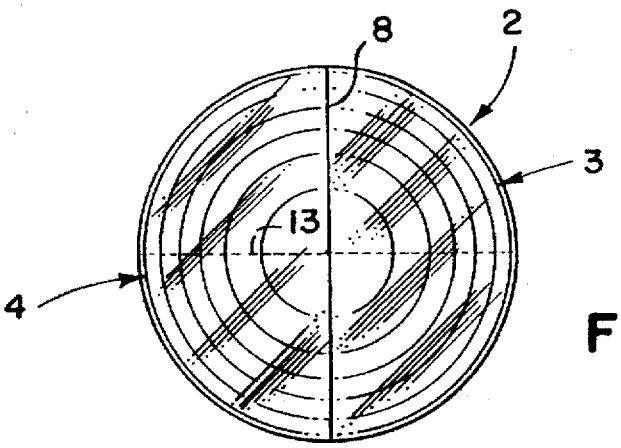
FIG. 7 is a top plan view of the segmented spherical display device taken in the direction indicated by arrows 7—7 in FIG. 2.

In terms of greater detail, and referring to FIGS. 1 through 7, inclusive, it will be seen from FIGS. 2 and 7, that the segmented sphere is designated generally by the numeral 2 and in these two figures is illustrated in its complete segmented spherical form. For purposes of greater clarity in the description and illustration of the spherical display device, it has been illustrated in these figures as fabricated from transparent material through which edge or demarcation lines that define the configurations of the various segment bodies and facets of the sphere, when viewed through the transparent material, are illustrated in lighter full lines than the object lines of the illustrations. Thus, referring to FIG. 1, it will there be seen that the spherical display body is illustrated in exploded form, comprising a right one-half segment body designated generally by the numeral 3, and a left-half segment body designated generally by the numeral 4. Referring first to the segment body 3, it will be seen that this segment body is fabricated as the mirror-image of the segment body 4, and includes a half-circle surface or facet 6 defined by a diametrical edge 7 and a semi-circular edge 8 that intercepts the spherically arcuate surface 9 of the segment body.

In like manner, the segment body 3 is also provided with a second half-circle surface or facet 12 lying in a plane perpendicular to the plane of the half-circle facet 6, and defined by the straight edge 13 and a semi-circular edge 14 that intercepts the spherically arcuate surface 9 of the segment body. Thus, it will be seen that in relation to each other, the facets 6 and 12 are perpendicular to one another, the facet 6 being coincident with a plane that encompasses one-half of the diameter of a sphere, while the facet 12 is perpendicular to the facet 6, and also encompasses a plane that extends half way through the diameter of a sphere. There thus remains a quarter-circle facet 16 bound on the one hand by one half of the edge 13 and on the other hand by the perpendicular edge 7, both of which edges intercept the spherically arcuate surface 9 and are connected by the circularly arcuate edge 17. Disposed in the same plane as the quarter-circle facet 16, but being diametrically opposed thereto with coincident apexes, is a second quarter-circle facet 18 defined on the one hand by one-half of the straight edge 7 and on the other hand by one-half the straight edge 13 extended to intercept the spherically arcuate periphery 9. The outer ends of these two edges are connected by a circularly arcuate edge 19 as shown to complete this multi-faceted segment body 3.

Referring to the segment body 4, also illustrated in FIG. 1, it will be seen that this segment body constitutes a mirror-image of the segment body 3, being provided with a half-circle facet 21 adapted to abut or be confrontingly juxtaposed to the facet 6 of the segment body 3 when the two segment bodies are arranged as in FIG. 2 to form a complete segmented sphere. A second half-circle facet 22 is also provided, the facets 21 and 22 being perpendicular to one another and each lying in a plane that is perpendicular to the plane of the other half-circle facet. As with the facet 6, the facet 21 is defined by the semi-circular edge 23 that intercepts the spherically arcuate surface 24 of the segment body 4, and by a diametrically extending edge 26. In like manner, the facet 22 is defined by a semi-circular edge 27 that intercepts the spherically arcuate surface 24, and a diametrically extending edge 28 that is perpendicular to the edge 26 and which extends for the full diameter of the segment body and sphere when formed.

Also provided are quarter-circle facets 29 and 31, the quarter-circle facet 29 being defined by the circularly arcuate edge 32 and edges 26 and 28. In like manner, the facet 31 is defined by the circularly arcuate edge 33 and edges 26 and 28. It should be noted that the quarter-circle facets 29 and 31 lie in a common plane, and that the apexes of these generally triangular facets 29 and 31 are coincident at the geometric center of the segment body and sphere when formed, which is also the median point of the edges 26 and 28. It should also be noted that with respect to the edge 26 that forms a boundary for the facet 29, that for one-half its length, where it forms the line of demarcation between the facets 21 and 29, the line 26 is not actually an edge, but constitutes a corner or line of demarcation between the facets 21 and 29. The same of course is true with respect to the edge 28 where it extends to form the line of demarcation between the facets 22 and 31. Thus, in this regard, the term "edge" is used to define both a true edge and a line of demarcation between two perpendicular surfaces. Obviously, the same situation occurs in the right segment body 3 of the spherical display device 2 where the edges 7 and 13, when extended to form a line of demarcation between the associated facets, is each nevertheless referred to as an "edge" despite the fact that it constitutes a line of demarcation between the two associated facets.

It will thus be seen that when the two segment bodies are provided with a support member or sheet 34 on which is provided indicia 36, and the support member 34 is caught between the two facets 6 and 21 as illustrated in FIG. 2, the indicia 36 is visible through the transparent spherical surface of the display device, and is in fact magnified in size as illustrated in FIG. 2. While I have indicated in this embodiment the placement of a support member provided with printed indicia, it should be understood that any type of indicia or other image bearing member may be juxtaposed between the flat facets 6 and 21, and between the flat facets 13 and 22 in such a manner as to render the indicia or image visible through the transparent medium of the sphere.

In like manner, the quarter-circle facets 6, 16, 29 and 33 may also be provided with either indicia or pictorial images, or both, so that when the two segment bodies 3 and 4 are interengaged as illustrated in FIG. 2, the indicia or pictorial images will be visible through the transparent material when the spherical display device is fabricated from a transparent material. While in this view I have indicated the support member 34, which constitutes a mounting member for the indicia, as being directly applied and supported between the facets 6 and 21, in a subsequent modification as will hereinafter be explained, a frame structure may be mounted on each of the facets of each segment body for the purpose of retaining and supporting the mounting member 34 or other mounting sheet on which indicia or pictorial images are supported.

Referring now to the second preferred embodiment illustrated in FIGS. 8 through 18, inclusive, it will there be seen that like the first embodiment illustrated in FIGS. 1 through 7, inclusive, this second embodiment of the invention involves a segmented spherical body divided into two segment bodies, each of which constitutes a mirror image of the other, so that the two segment bodies may be interengaged to form a complete segmented sphere. Compared with the embodiment of FIGS. 1 and 2, whereas that embodiment incorporated mirror-image segment bodies each of which included two half-circle and two quarter-circle facets, the embodiment of the invention illustrated in FIGS. 8 through 18, also incorporates two mirror-image segment bodies, but in this case, each of the mirror-image segment bodies includes six quarter-circle facets with no half-circle facets included in the structure.

Figures 8, 9:
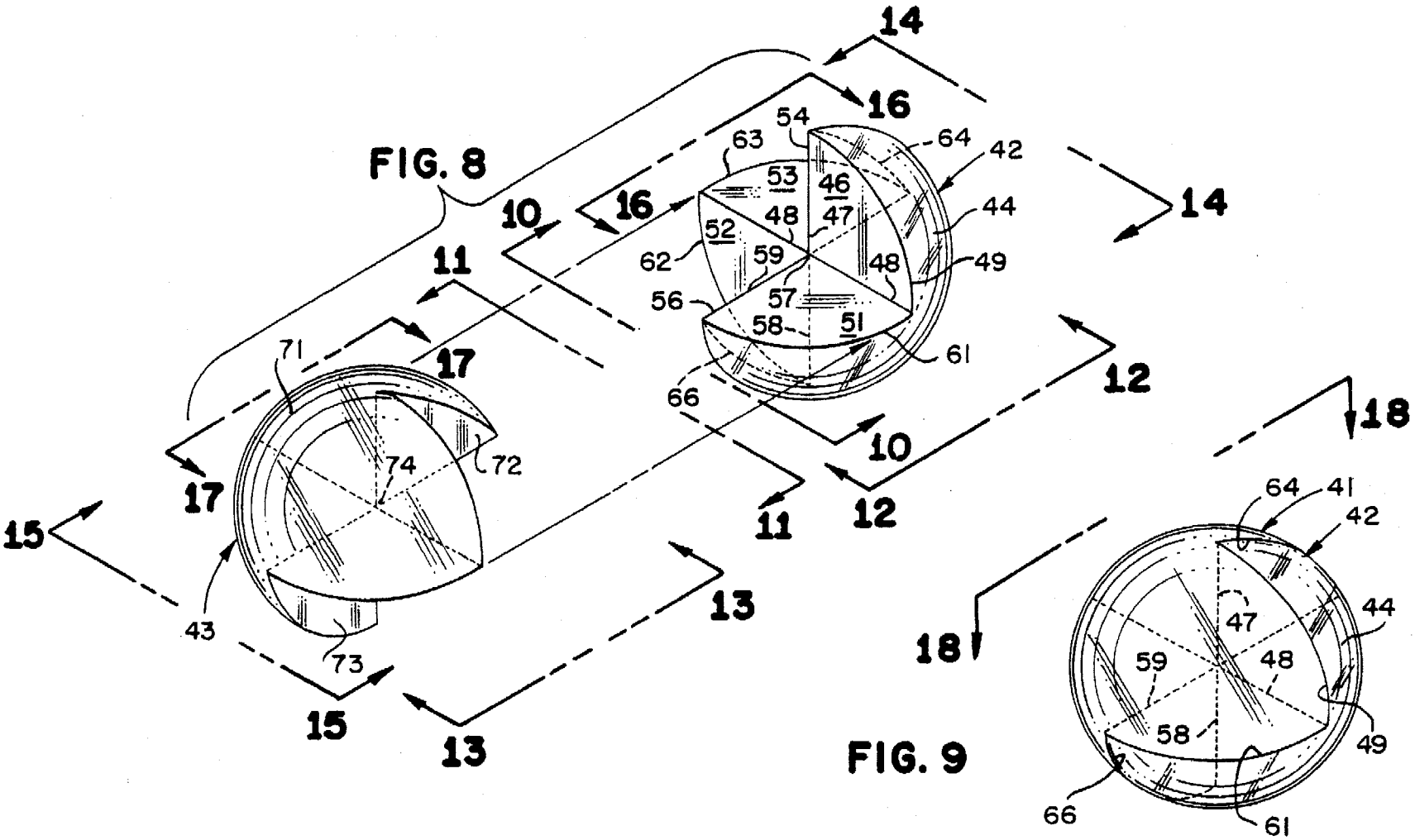
FIG. 8 is a perspective exploded view of a second preferred embodiment of my segmented spherical display device shown fabricated from transparent material, with the two transparent mirror-image segment bodies spaced apart to reveal various of the facets on which visual displays may be mounted.
FIG. 9 is a perspective view of the segmented spherical display device of FIG. 8, shown with the two transparent mirror-image segment bodies interengaged to form a complete sphere to enable viewing of the displays through the transparent spherical surface.
Figure 10:
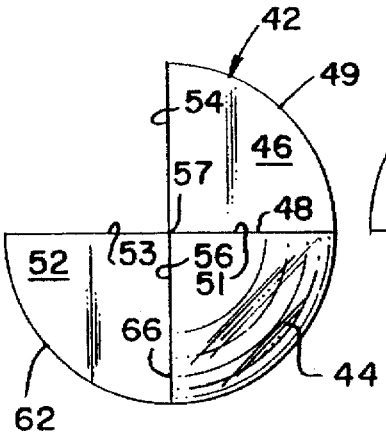
FIG. 10 is an elevational confronting view of the right-hand segment body of the display device of FIG. 8, taken in the direction indicated by the arrows 10—10 in FIG. 8.
Figure 11:
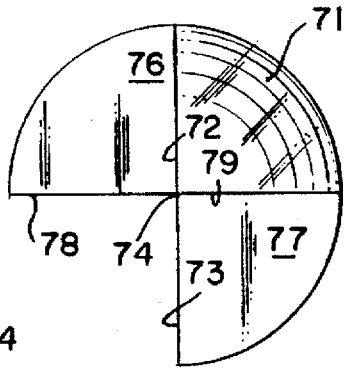
FIG. 11 is an elevational confronting view of the left-hand segment body of the display device of FIG. 8, taken in the direction indicated by the arrows 11—11 in FIG. 8.
Figure 12:
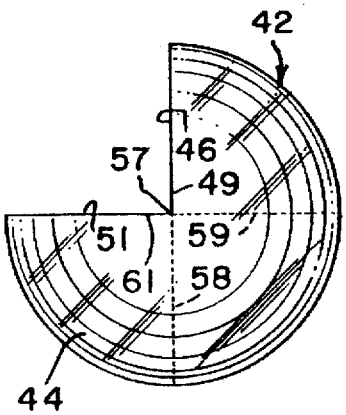
FIG. 12 is an elevational side view of the right-hand segment body of the display device of FIG. 8, taken in the direction indicated by the arrows 12—12 in FIG. 8.
Figure 13:
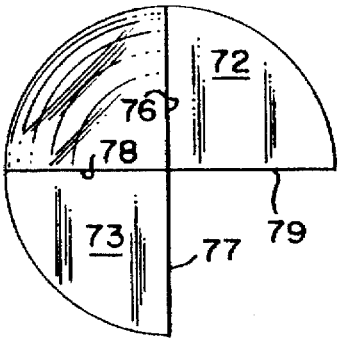
FIG. 13 is an elevational side view of the left-hand segment body of the display device of FIG. 8, taken in the direction of the arrows 13—13 in FIG. 8.
Figure 14:
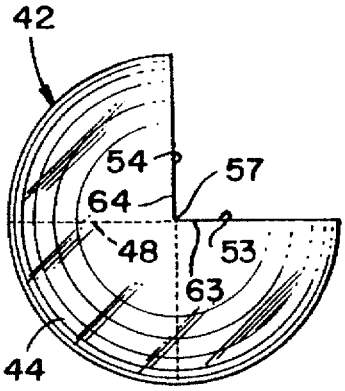
FIG. 14 is an elevational view of the right-hand segment body of the display device of FIG. 8, taken in the direction indicated by the arrows 14—14 in FIG. 8.
Figure 15:
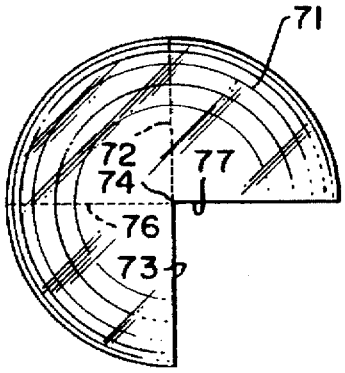
FIG. 15 is an elevational view of the left-hand segment body of the display device of FIG. 8, taken in the direction indicated by the arrows 15—15 in FIG. 8.
Figure 16:
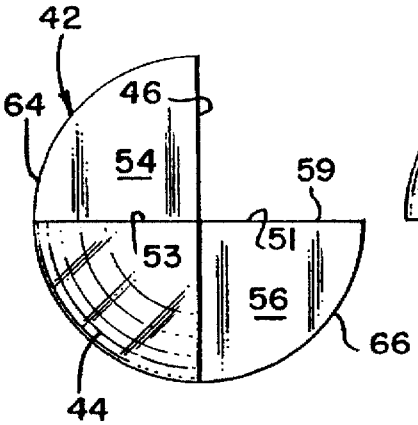
FIG. 16 is an elevational side view of the right-hand segment body shown in FIG. 8, taken in the direction indicated by the arrows 16—16 in FIG. 8.
Figure 17:
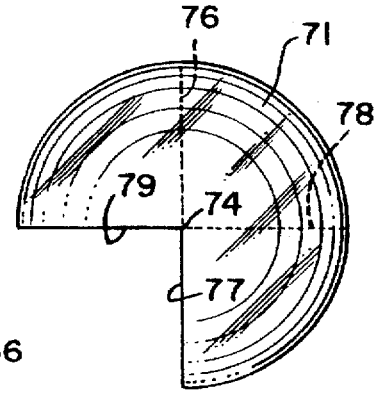
FIG. 17 is an elevational side view of the left-hand segment body shown in FIG. 8, taken in the direction indicated by the arrows 17—17 in FIG. 8.
Figure 18:
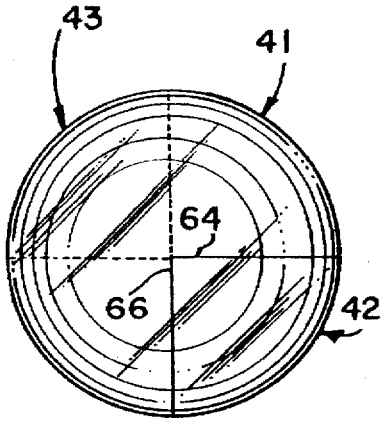
FIG. 18 is a top plan view of the segmented spherical display device of FIG. 8, taken in the direction indicated by the arrows 18—18 in FIG. 9.

Accordingly, referring specifically to FIGS. 8 through 18, inclusive, it will be noted that in this second embodiment the complete segmented sphere is designated generally by the numeral 41 and is formed by the precise interengagement of the two separate and mirror-image segment bodies designated generally by the numerals 42 and 43, respectively. Referring first to the right-hand segment body 42 shown in FIG. 8, it will there be seen that the segment body includes a spherically arcuate surface portion 44 which encompasses one-half of the entire surface area of the complete segmented sphere 41 when the two mirror-image segment bodies 42 and 43 are interengaged as illustrated in FIG. 9. It will also be noted that the segment body 42 includes a first quarter-circle facet 46 constituting a flat surface bounded by edges 47 and 48, each of which constitutes one-half of a straight diametrical line extending from opposite peripheral spherically arcuate surfaces and through the geometric center of the body. The facet 46 is also defined by a quarter-circle arcuate edge 49 that follows the curvature of the spherically arcuate surface 44.

In like manner, the segment body 42 includes a second quarter-circle flat facet 51, a third quarter-circle flat facet 52, a fourth quarter-circle flat facet 53, a fifth quarter-circle flat facet 54, and a sixth quarter-circle flat facet 56. Facets 46 and 54 share the common boundry edge 47 which when extended through the geometric center 57 of the segment body, which is also the geometric center of the segmented sphere when formed by the interengaging juxtaposition of the two mirror-image segment bodies, constitutes an "edge" or line of demarcation 58 between the facets 52 and 56.

Similarly, the facets 52 and 53 are separated or partially defined by the edge 48 which between the facets 46 and 51 constitutes an "edge" or line of demarcation between these two facets. One edge of the facet 51 and facet 56 is defined by the edge 59 which when extended through the geometric center 57 of the segment body and sphere constitutes the "edge" or line of demarcation between the facets 53 and 54. Each of the generally triangular quarter-circle facets is also bounded or defined by a quarter-circle arcuate edge, the facet 51 being subtended within the circularly arcuate edge 61, while the facet 52 includes the circularly arcuate edge 62. The facet 53 includes the circularly arcuate edge 63, while the adjacent facet 54 includes the circularly arcuate edge 64. Regarding the facet 56, it, too, is provided with a circularly arcuate edge 66.

It will thus be seen that with respect to the segment body 42, which constitutes a mirror-image of the segment body 43, it also includes three pairs of facets, with the facets of each pair lying in a common plane that is angularly disposed to the planes in which the other pairs of facets are included. Thus, the facets 51 and 53 lie in a common plane, the facets 46 and 52 lie in a common plane, while the facets 54 and 56 also lie in a common plane, each of these planes being related to the other planes by an angle of ninety (90) degrees. Note also that each of the six facets has an apex that is coincident with the geometric center 57 of the segment body and sphere formed by the juxtaposition of the mirror-image segment bodies, and that the planes within which the pairs of facets are included also pass through the geometric center 57 of the segment body and sphere.

In the interest of brevity in this description, and referring to the left-hand segment body 43 of the spherical display device illustrated in exploded form in FIG. 8, only an abreviated description of the major components of the left-hand segment body will be described inasmuch as the segment body 43 constitutes the exact mirror-image of the segment body 42 which has heretofore been described in detail. Thus, the segment body 43 includes a spherically arcuate surface portion 71 that constitutes one-half of the total surface area of the complete segmented sphere formed by interengaging in juxtaposition the two segment bodies as illustrated in FIG. 9. Segment body 43 also includes quarter-circle flat facets 72 and 73 which lie in a common plane and each of which has an apex that is coincident with the geometric center 74 of the segment body. In like manner, two additional pairs of facets are included in segment body 43, but are not clearly visible in the illustration of this segment body in FIG. 8. Accordingly, reference is now made to FIGS. 11, 13, 15 and 17 wherein these additional facets are illustrated. Thus, referring to FIG. 11, it will be seen that the facets 72 and 73 are illustrated in this figure as contained within a plane that is perpendicular to the plane within which the facets 76 and 77 are contained.

Figure 19:
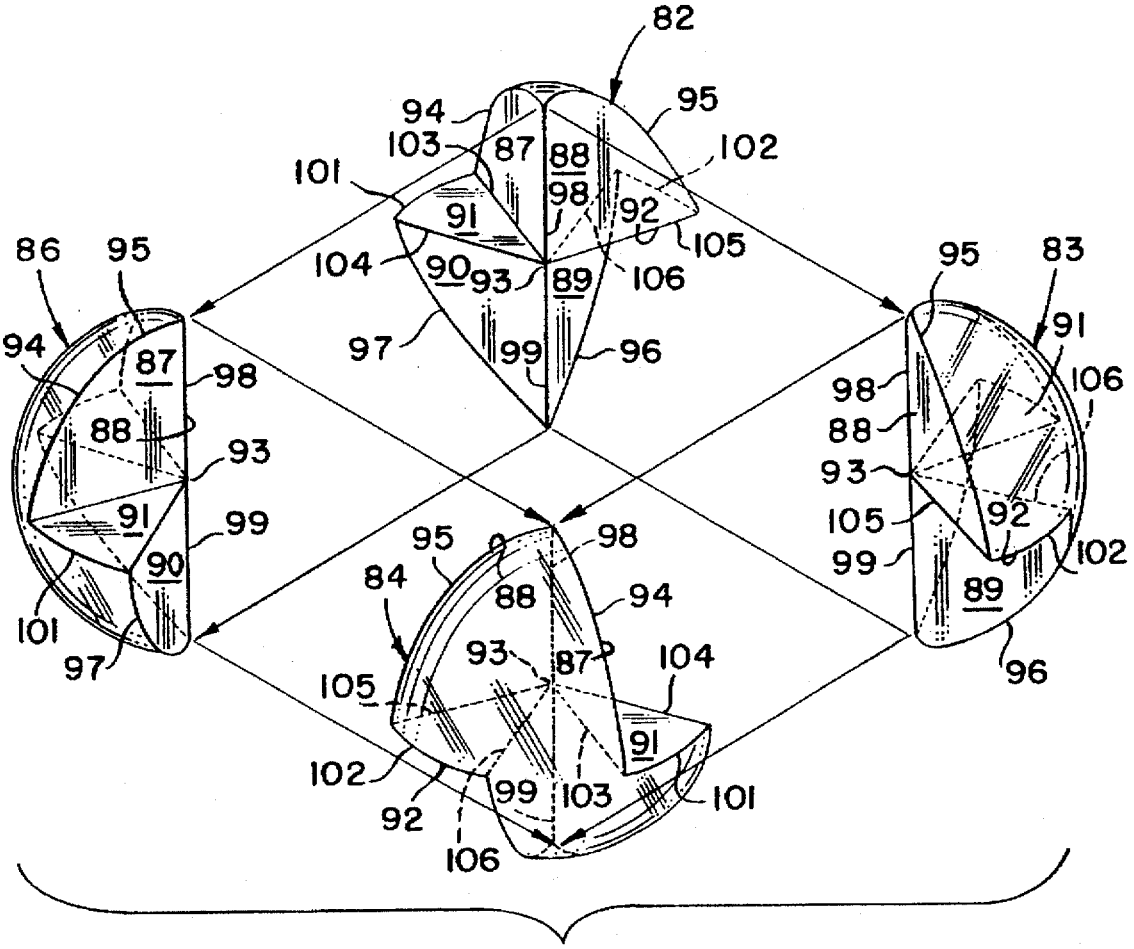
FIG. 19 is an exploded perspective view of a third preferred embodiment of my segmented spherical display device shown transparent with four segment bodies spaced apart for clarity, and indicating by arrow lines the direction in which the segment bodies are moved to form a transparent spherical body.
Figure 20:
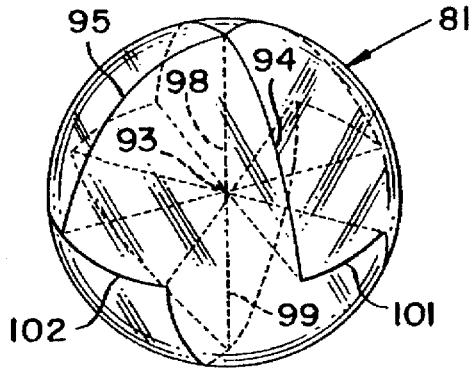
FIG. 20 is a perspective view illustrating the four segment bodies of FIG. 19 interengaged to form a spherical body.

Referring now to the third preferred embodiment of the invention illustrated in FIGS. 19 and 20, it will be seen from FIG. 20 that the spherical display device is designated generally by the numeral 81, is divided or segmented into four mirror-image segment bodies designated generally by the numerals 82, 83, 84 and 86. Again, in the interest of brevity in this description, and since the segment bodies 82, 83, 84 and 86 constitute mirror-images of one another, the segment body 82 will be described in detail and reference numerals applied thereto with the understanding that the same elements indicated in segment body 82 correspond to similar elements in each of the other segments bodies, each of the segment bodies constituting one-fourth of the entire sphere so that when the separate segment bodies are interengaged as indicated by the directional arrows in FIG. 19, a complete segmented sphere 81 is formed as illustrated in FIG. 20.

Thus, referring to the segment body 82 in FIG. 19, it will be seen that this segment body includes four quarter-circle facets designated, respectively, by the numerals 87, 88, 89 and 90. In addition to these four quarter-circle facets, each segment body also includes two additional facets 91 and 92 that are both coincident with a common plane that is perpendicular to the respective planes of the quarter-circle facets, each of which facets are angularly disposed with respect to the other quarter-circle facets.

It is important to note that with respect to each of the facets included in the segment body 82, and of course in the other three segment bodies 83, 84 and 86, the apexes of the facets are coincident at a point 93 that also forms the geometric center of the segmented sphere as illustrated in FIG. 20. Another relationship that is important is that with respect to the segment body 82, and each of the other segment bodies that make up the segmented sphere, the planes in which the quarter-circle facets lie are vertical while the plane in which the eighth-circle facets 91 and 92 lie is horizontal and perpendicular to the planes within which the quarter-circle facets are contained. Additionally, it will be noted that each of the quarter-circle facets is bounded by a circular arc subtending ninety degrees with respect to the geometric center 93. Thus, the facet 87 at its outer periphery is bounded by the circularly arcuate edge 94, while the facet 88 on its outer circular periphery is bounded by the edge 95. In like manner, the facet 89 is bounded on its circular periphery by a circularly arcuate edge 96, while the facet 90 is bounded on its circular periphery by a circularly arcuate edge 97. Another relationship that is important is that the facets 87 and 88 are angularly disposed to one another by ninety degrees, and each shares a common edge 98. In like manner the facets 89 and 90 are disposed with respect to one another at a ninety degree angle, and share the common edge 99. It is also important to note that the planes that contain the facets 87 and 88 are offset by forty-five degrees from the vertical planes that contain the quarter-circle facets 89 and 90. In this way, the horizontal facet 91 is bounded by a circularly arcuate edge 101, while the horizontal facet 92 is bounded by a circularly arcuate edge 102. In like manner, because of the forty-five degree offset of the facet 87 from the facet 90, and the facet 88 from the facet 89, a line of demarcation or "edge" 103 is formed that is shared by the facets 87 and 91. Radially extending edge 104 completes the facet 91, while the edges 105 and 106 complete the facet 92. It should be noted that the edge 105 is a common edge to facets 88 and 92. In the same manner, the edge 104 is a common edge to the facets 90 and 91.

Thus, when the four segment bodies 82, 83, 84 and 86 are interengaged by movement of the respective segment bodies in the directions indicated by the arrow lines of FIG. 19, the result will be the completion of a segmented sphere as illustrated in FIG. 20. Stated another way, when the segment body 82 is moved toward the segment body 86, for instance, the facet 87 will lie juxtaposed to the facet 88, while the facet 91 of the segment 82 will lie juxtaposed to the facet 92 of the segment 86. Because of the mirror-image characteristics of each of the segment bodies, it will be seen that corresponding facets of each of the segment bodies will lie juxtaposed when the four segment bodies are interengaged to form the completed segmented sphere as illustrated in FIG. 20.

Figure 21:
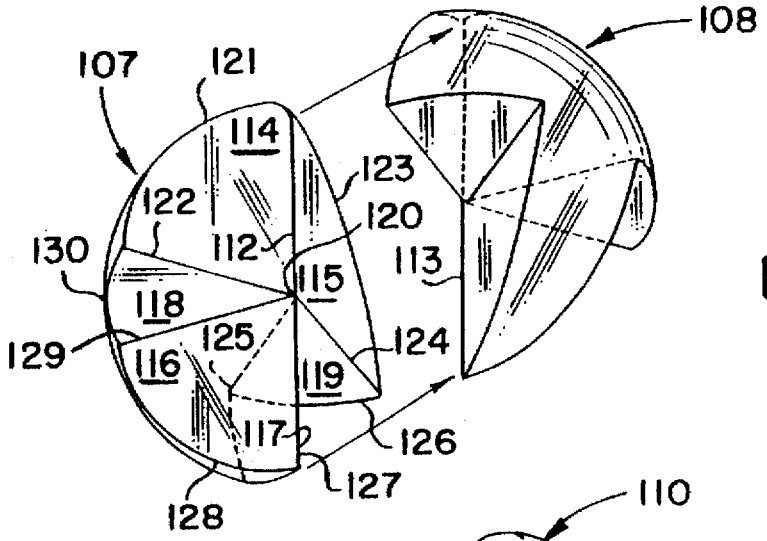
FIG. 21 is a perspective view of two confronting segment bodies forming one-half of a fourth preferred embodiment of my segmented spherical display device embodying four mirror-image segment bodies.
Figure 22:
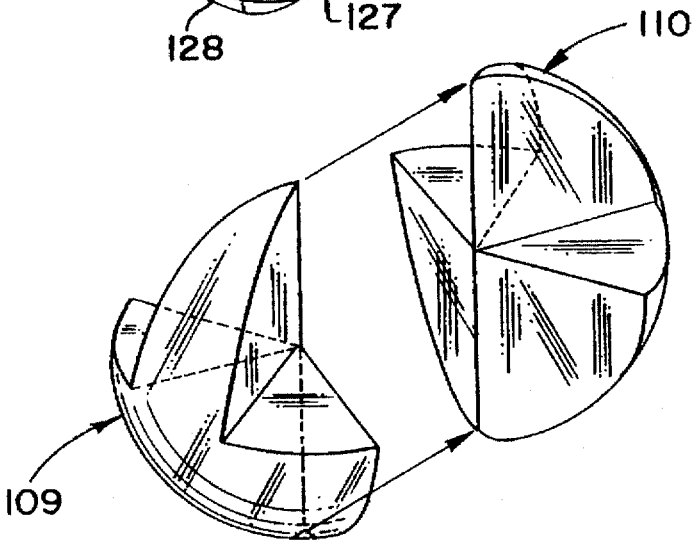
FIG. 22 is a perspective view of two confronting segment bodies forming the remaining one-half of the fourth preferred embodiment of my spherical display device, and arranged to interengage with the confronting segment bodies illustrated in FIG. 21 to form a four-part spherical display device.
Figure 23:
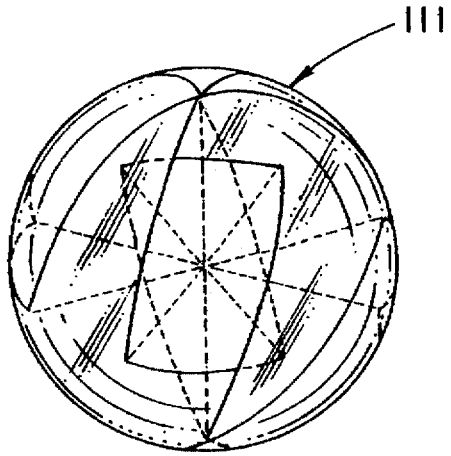
FIG. 23 is a perspective view of the four segment bodies illustrated in FIGS. 21 and 22, showing the four segment bodies fully interengaged to form a transparent spherical display device according to the invention.

Referring to FIGS. 21 and 22, the separated segment bodies of a sphere as illustrated in these two figures, which collectively illustrate the fourth embodiment of the invention, bears an important relationship to the four-segment third embodiment illustrated in FIGS. 19 and 20, in that each of the four segment bodies illustrated in FIGS. 21 and 22, also constitutes one-fourth of the total volume of the segmented sphere that is ultimately formed when the four segment bodies illustrated in FIGS. 21 and 22 are interengaged as illustrated in FIG. 23. However, there is an important difference between the construction of the segment bodies of FIGS. 21 and 22 from the segment bodies illustrated in FIG. 19 in that the planes containing the facets 87 and 88 in FIG. 19 are angularly disposed at ninety degrees, as are the planes that contain the facets 89 and 90 in FIG. 19. However, in FIGS. 21 and 22, it will be seen, as will hereinafter be explained, that the vertical planes within which the various facets are coincident, are arranged angularly to one another at less than ninety degrees.

Referring to FIGS. 21 and 22, it will be noted that the four segment bodies 107, 108, 109 and 110 are again mirror-images of one another, and that they are configured in a manner so that when interengaged they form a segmented sphere 111 as illustrated in FIG. 23. Referring to FIG. 21, the two segment bodies 107 and 108 are illustrated separated from one another and positioned so that when moved toward one another in the direction of the arrowed lines, the diametrical edge 112 of segment body 107 will coincide with diametrical edge 113. It should be noted that the diametrical edges 112 and 113 extend for the full diameter of the completed sphere 111. It should also be noted that with respect to segment body 107, the diametrical edge 112 is common to flat-surfaced facets 114, 115, 116 and 117, each facet being coincident with a vertical plane that is angularly disposed in relation to the vertical planes coincident with the other facets, and none of which vertical planes are coincident with one another.

Segment body 107 is thus a quarter-sphere body configured to present four quarter-circle facets 114, 115, 116 and 117, and two additional horizontally oriented flat-surfaced facets 118 and 119 coincident in a common horizontal plane that is perpendicular to all the planes with which the quarter-circle facets are coincident. All six of the facets include an apex that is coincident with the geometric center 120 of the segmented sphere, which is also the median point of the diametrical edge 112 in segment body 107. Thus, the quarter-circle facet 114 is bounded by the circularly arcuate edge 121, radially extending edge 122 that is common to facet 118 and one-half the length of the diametrical edge 112, that is also common to the facet 115 as shown.

Facet 115 is bounded by the half portion of vertical edge 112 shared with facet 114, circularly arcuate edge 123, and radially extending edge 124 shared commonly with facet 119. Facet 119 is in turn bounded by radially extending "edge" or demarcation line 125 and circularly arcuate edge 126. The "edge" or line of demarcation 125 is the boundary not only of facet 119 but shares this function with facet 117, which is also bounded by radially extending edge 127, circularly arcuate edge 128, and "edge" or line of demarcation 129, the latter "edge" of demarcation being common with horizontal facet 118 as shown. Facet 118 is also bounded by radially extending edge 122 shared with facet 114, and with circularly arcuate edge 130.

It will thus be seen from FIG. 21 that the segment body 107 includes four quarter-circle facets coincident with vertical planes that are angularly disposed in relation to one another, the facets 116 and 117 by an angle of forty-five degrees, while the facets 114 and 115 are one-hundred thirty-five degrees apart. The facets 118 and 119 each subtend an angle of forty-five degrees. Thus, when the two segment bodies 107 and 108 are moved into engagement so that the diametrical edges 112 and 113, respectively, are coincident, the facets 114 and 115 will be spaced forty-five degrees from the corresponding facets on the segment body 108. The facets 116 and 117, on the other hand, are spaced one-hundred thirty-five degrees from corresponding facets on the segment body 108. Since each of the segment bodies 107, 108, 109 and 110 are identical, in the interest of brevity in this description, the same reference numbers applied to segment body 107 have been applied to corresponding elements of segment bodies 108, 109 and 110.

To arrange the separated segment bodies as illustrated in FIGS. 21 and 22 into the segmented spherical arrangement illustrated in FIG. 23, several methods may be used. One method includes moving the two segment bodies 107 and 108 together to bring the diametrical edges 112 and 113 into coincidence. While these two segment bodies are supported in this relationship, the segment bodies 109 and 110 are similarly arranged, and then the two groups of joined segment bodies are interengaged by lowering the joined upper segment bodies onto the joined lower segment bodies to bring the appropriately related facets into juxtaposition.

Alternatively, the upper segment body 107 may be lowered into engagement with the lower segment body 109 so that the facet 118 of the segment body 107 lies juxtaposed to the corresponding facet 118 on the segment body 109. In this relationship, the facet 114 of segment body 107 will lie juxtaposed to facet 116 of segment body 109 so as to form one-half of the segmented sphere. Then, upper segment body 108 may be interengaged in like manner with the lower segment body 110 so that the horizontal facet 119 of segment body 108 lies juxtaposed to the corresponding horizontal facet of segment body 110. The two joined segment bodies 108/110 may then be moved toward the joined segment bodies 107/109 to interengage corresponding facets in a juxtaposed relationship that results in the complete definition of the segmented sphere 111.

It will of course be understood that each of the segment bodies of the four different embodiments may be utilized as a stand-alone support for display of printed indicia or visual images of different types without utilizing them in an interengaged relationship to form a segmented sphere, as herein described and illustrated. It should also be understood that instead of using a transparent material for the fabrication of the segment bodies, a completely opaque material, such as wood or metal, may be utilized and the printed indicia and/or visual images mounted directly on the facets for display when the individual segment bodies are utilized as stand-alone support devices for the indicia and/or visual images.

When opaque material is used, the indicia and/or visual images mounted on the various facets are of course hidden from view when the segment bodies are interengaged to form the segmented sphere. In either case, when either transparent or opaque material is used to fabricate the individual segment bodies, each of the facets, or selected ones thereof, may be utilized to support one or more frames which are permanently attached to a peripheral surface portion of a selected one or all of the separate facets for the purpose of detachably retaining within such frame on the associated facet a support member on which indicia and/or visual images are displayed.

Figure 24:
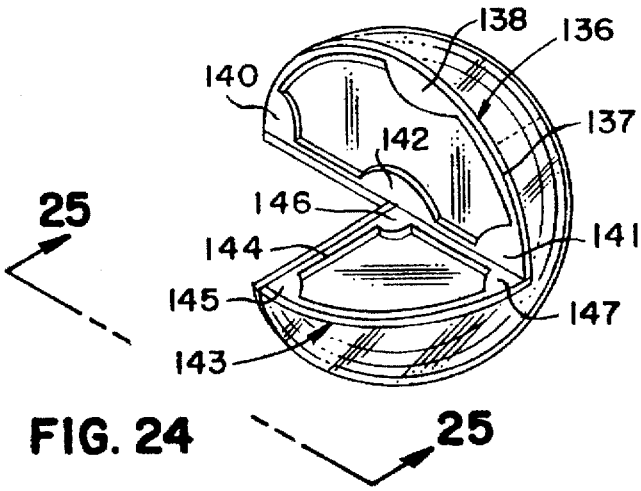
FIG. 24 is a perspective view of one of the segment bodies of the first embodiment illustrated in FIG. 1 having attached to its flat facets a frame structure for detachably retaining a support sheet on which is carried printed indicia and/or a visual image.
Figure 25:
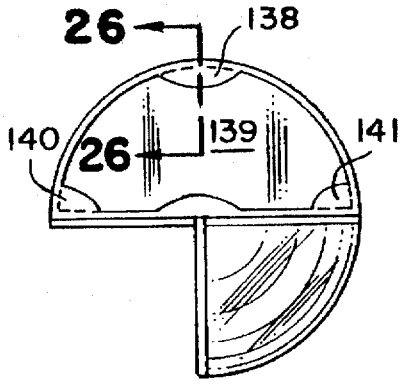
FIG. 25 is an elevational view of a segment body taken in the direction of the arrows 25—25 in FIG. 24.
Figure 26:
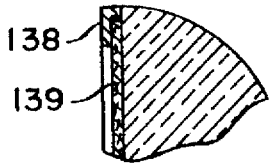
FIG. 26 is a fragmentary vertical cross-sectional view taken in the plane indicated by the arrow line 26—26 in FIG. 25 and illustrating the nature of the retention tabs formed in each corner of each frame member, and showing a support member for indicia or visual images caught under a retention tab.

In that regard, reference is made to FIGS. 24 through 31, inclusive, wherein the application of such a frame is illustrated for the four embodiments described and claimed herein. FIGS. 24, 25 and 26, being representative of the first preferred embodiment described above, illustrate a frame designated generally by the numeral 136, preferably fabricated from metal, but also susceptible of fabrication from an appropriate plastic. The frame includes a perimeter portion 137 that follows the contour of the perimeter of the facet to which the frame is attached, preferably by an appropriate adhesive.

In the embodiment illustrated, it will be seen that a frame 136 is attached to each of the half-circle facets of the display device. Additionally, at the median point of the arcuate perimeter portion 137, the frame is provided with a widened retention flange 138 which, as shown in FIG. 26, is slightly thinner than the perimeter portion with which it is integral and from which it projects, thus providing a space between the flange and the surface of the facet which can accept the insertion of the edge portion of a mounting member 139 on which the indicia and/or visual image is borne.

To ensure that the mounting member 139 remains detachably secured to the surface of the facet, the corners of the frame are also formed with flanges 140 and 141, both of which complement a fourth retention flange 142 projecting from the median point of the straight perimeter portion of the frame 136 as shown. All of the retention flanges are thinner than the perimeter portion with which they are integral and from which they project, thus providing a space between the underside of each and the surface of the facet, forming a four-point system for detachably retaining the support member for the indicia and/or visual image on the facet.

As illustrated best in FIG. 24, in this embodiment each of the quarter-circle facets is also provided with a generally triangular mounting frame designated generally by the numeral 143, fabricated similarly to the frame 136, to conform to the configuration of the perimeter of the facet to which it is attached, conveniently by adhesive. As with the frame 136, the frame 143 is provided with a narrow perimeter 144, and at its corners with retention flanges 145, 146 and 147, each of which is thinner, i.e., less in thickness than the perimeter portion, so as to provide a space between the underside of each retention flange and the associated surface of the facet to which the frame is adhesively attached.

Figure 27:
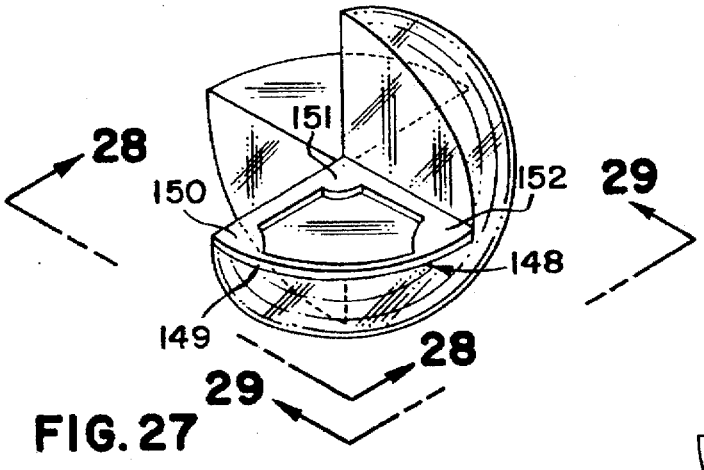
FIG. 27 is a perspective view of one of the segment bodies of the second embodiment of the invention shown equipped with a frame member on one of its facets for detachably retaining a support member bearing indicia or a visual image.
Figure 28:
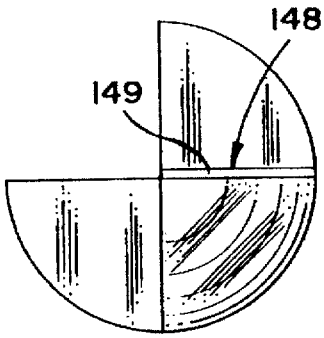
FIG. 28 is an elevational view taken in the direction of the arrows 28—28 in FIG. 27.

Referring to FIG. 27, a replication of the second embodiment of the invention illustrated and described above, it will be seen that a generally triangular frame designated generally by the numeral 148 is attached to the generally triangular facet for the purpose of detachably retaining a support member for indicia and/or a visual image. The frame 148 includes a perimeter portion 149 conforming to the configuration of the perimeter of the facet to which it is attached, and is provided also with retention flanges 150, 151, and 152, each of which is integral with perimeter portion 149 but less thick, thus providing a space between the underside of each flange and the associated surface of the facet so that a support member bearing indicia and/or a visual image may be detachably tucked under the flanges and retained thereby. In the interest of brevity in this description only one frame is illustrated on the display device of FIGS. 27, 28 and 29, but it should be understood that a similar frame may be permanently mounted on each of the six separate facets of the segment body illustrated.

Figure 30:
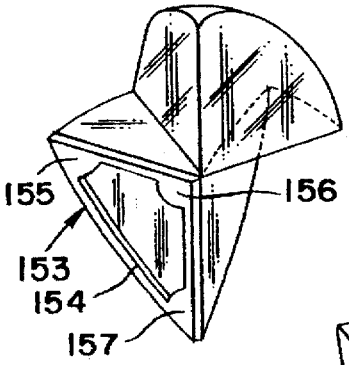
FIG. 30 is a perspective view of one of the segment bodies of the third embodiment of the invention shown with one of its facets equipped with a frame member for detachably retaining a support member bearing indicia and/or visual images.

In the third preferred embodiment illustrated in FIG. 30, it will be seen that while the segment body illustrated possesses four quarter-circle facets and two less-than-quarter-circle facets, only one frame designated generally by the numeral 153 is illustrated, mounted on one of the quarter-circle facets. This frame, too, is fabricated with a continuous perimeter 154 conforming to the configuration of the perimeter of the facet, and with flanges 155, 156 and 157 similar to those previously described to provide a space between the underside of each flange and the surface of the facet into which the corners of a mounting member bearing indicia and/or visual image may be inserted for detachable retention therein. Each of the facets may of course selectively be provided with its own frame.

Figure 31:
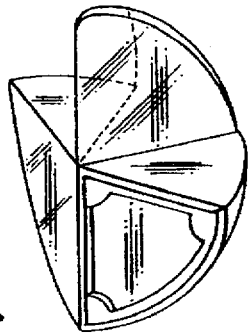
FIG. 31 is a perspective view of one of the segment bodies of the fourth embodiment of the invention shown with one of its facets equipped with a frame member for detachably retaining a support member bearing indicia and/or visual images.
Figure 29:
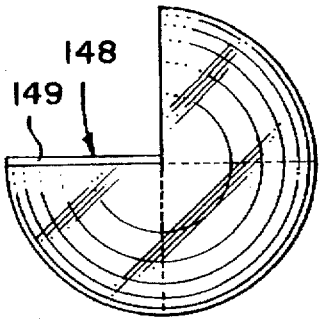
FIG. 29 is an elevational view taken in the direction of the arrows 29—29 in FIG. 27.

The fourth preferred embodiment of the invention illustrated in FIG. 31, while having four quarter-circle facets and two less-than-quarter-circle facets is, like the embodiment of FIG. 30, provided with only one frame designated generally by the numeral 158. This frame is also generally triangular and possessed of a perimeter portion 159 configured to conform to the configuration of the facet to which it is firmly secured. Integral with the perimeter portion are retention flanges 160, 161, and 162, each spaced above the associated surface of the facet to enable the detachable retention of a support member bearing indicia and/or a visual image as previously described.

In terms of methods of manufacture, or fabrication, the segmented spherically configured display device may be fabricated by conventional techniques, such as the use of cutting devices to form each segment body into the configuration illustrated. Where more expedient, each of the segment bodies of the segmented sphere may be injection molded from an appropriate synthetic resinous material, commonly known as "plastic", transparent or not, or cut from metal through use of electric discharge machining (EDM), or otherwise, and formed from materials such as wood, stone, jade and marble.

Having described the invention, what is believed to be new and novel, and sought to be protected by letters patent of the United States, is as follows.

I claim:

1. A segmented sphere for displaying indicia and/or visual images, comprising:

a) a plurality of individual segment bodies each a mirror-image of one another and configured to form said segmented sphere when interengaged with each other in a confronting relationship; and b) a plurality of flat facets formed on each segment body on which indicia and/or visual images may be supported, each facet bounded by at least one radially extending edge and a circularly arcuate edge;

c) said flat facets of each segment body being juxtaposed to corresponding flat facets of a confronting segment body when said plurality of segment bodies are interengaged to form said segmented sphere.

2. The segmented sphere according to claim 1, wherein at least two of said plurality of flat facets formed on each segment body comprises a quarter-circle.

3. The segmented sphere according to claim 1, wherein at least one of said plurality of segment bodies is fabricated from transparent material.

4. The segmented sphere according to claim 1, wherein at least one of said plurality of segment bodies is fabricated from an opaque material.

5. The segmented sphere according to claim 1, wherein said plurality of segment bodies are fabricated from a transparent material.

6. The segmented sphere according to claim 1, wherein said plurality of segment bodies are fabricated from an opaque material.

7. The segmented sphere according to claim 1, wherein each of said plurality of segment bodies includes at least two flat facets that are less than a half-circle and lie in a common plane.

8. The segmented sphere according to claim 7, wherein corresponding apexes of said at least two flat facets that lie in a common plane are coincident at the geometric center of said segmented sphere.

9. The segmented sphere according to claim 1, wherein each of said plurality of facets is coincident with a plane that includes the geometric center of the segmented sphere formed when said segment bodies are interengaged to form said segmented sphere.

10. The segmented sphere according to claim 1, wherein each said segment body includes at least a first pair of flat facets coincident with a common plane that includes the geometric center of said segmented sphere and a second pair of flat facets each coincident with a plane angularly disposed to the plane of the other facet of the second pair and perpendicular to the plane common to said first pair of facets.

11. The segmented sphere according to claim 1, wherein each said segment body includes a 180 degree peripheral surface portion of said segmented sphere subtending a diametrically extending edge on said segment body that includes the geometric center of said segmented sphere.

12. The segmented sphere according to claim 1, wherein each of said plurality of segment bodies comprises one-half of said segmented sphere.

13. The segmented sphere according to claim 1, wherein each of said plurality of segment bodies comprises one-fourth of said segmented sphere.

14. The segmented sphere according to claim 13, wherein each segment body includes four quarter-circle facets angularly disposed to one another and two eighth-circle facets coincident with a common plane.

15. The segmented sphere according to claim 14, wherein each of said two facets of less than a quarter-circle are eighth-circle facets.

16. The segmented sphere according to claim 14, wherein each segment body includes first and second portions arranged about a diametrical edge and each of said first and second portions includes a pair of quarter-circle facets divergent at a predetermined angle from said diametrical edge, said first portion being angularly offset about said diametrical edge in relation to said second portion whereby one of said two facets of less than a quarter-circle is included in each of said first and second portions.

17. The segmented sphere according to claim 16, wherein each of said two facets of less than a quarter-circle are eighth-circle facets and the plane in which they are coincident is perpendicular to said diametrical edge.

18. The segmented sphere according to claim 16, wherein the predetermined angle by which the facets of each pair of facets diverge is ninety degrees.

19. The segmented sphere according to claim 18, wherein the quarter-circle facets of said first portion are angularly offset from the quarter-circle facets of said second portion by the angular offset of said first and second portions.

20. The segmented sphere according to claim 16, wherein one of said two facets of less-than-a-quarter-circle is included on the lower surface of the first portion while the other less-than-quarter-circle facet is included on the upper surface of said second portion whereby when two segment bodies are interengaged the less-than-quarter-circle facet included in the lower surface of said first portion of one segment body lies juxtaposed to the less-than-quarter-circle facet on the upper surface of the second portion of the associated segment body whereby the two associated segment bodies complete one-half of said segmented sphere.

21. The segmented sphere according to claim 14, wherein each segment body includes first and second portions arranged about a diametrical edge and each of said first and second portions includes a pair of quarter-circle facets divergent at a predetermined angle from said diametrical edge, the quarter-circle facets of said first portion being divergent at an angle less than ninety degrees while the quarter-circle facets of said second portion are divergent at an angle greater than ninety degrees, and said two facets of less than a quarter-circle are included in said second portion.

22. The segmented sphere according to claim 21, wherein said quarter-circle facets of said first portion diverge at an angle of forty-five degrees.

23. The segmented sphere according to claim 21, wherein said quarter-circle facets of said second portion diverge at an angle of one-hundred thirty-five degrees.

24. The segmented sphere according to claim 21, wherein said less than quarter-circle facets are angularly offset about said diametrical edge forty-five degrees and lie symmetrically on opposite sides of said first portion.

25. The segmented sphere according to claim 1, wherein each said segment body includes two quarter-circle flat facets and two half-circle flat facets.

26. The segmented sphere according to claim 25, wherein said two quarter-circle facets lie on opposite sides of the geometric center in planar alignment in a common plane.

27. The segmented sphere according to claim 25, wherein said two half-circle facets are perpendicular to one another, each half-circle facet being coincident with a plane that is perpendicular to the other and both planes including the geometric center of the segmented sphere.

28. The segmented sphere according to claim 25, wherein said two half-circle facets are perpendicular to one another and to said two quarter-circle facets.

29. The segmented sphere according to claim 1, wherein each said segment body includes a multiplicity of quarter-circle flat facets.

30. The segmented sphere according to claim 29, wherein said multiplicity of facets are arranged in three pairs of quarter-circle facets, each facet of each pair of facets lying on the opposite side of the geometric center of said sphere from the other facet of the pair.

31. The segmented sphere according to claim 30, wherein each said pair of facets is coincident with a plane that is perpendicular to the planes coincident with the other two pairs of facets.

32. The segmented sphere according to claim 1, wherein each facet is bounded by two radially extending edges converging at corresponding ends to an apex coincident with the geometric center of said body, the edge of each said facet opposite its respective apex being circularly arcuate and joining the opposite ends of said two radially extending edges remote from said apex.

33. The segmented sphere according to claim 1, wherein said indicia and/or visual images are borne by a support member, and means are provided on selected ones of said flat facets for retaining a support member bearing said indicia and/or visual images.

34. The segmented sphere according to claim 33, wherein said means for retaining said support member comprises a frame fixed to the associated facet.

35. The segmented sphere according to claim 34, wherein said frame is configured to conform to the perimeter portion of the associated facet.

36. The segmented sphere according to claim 35, wherein said frame is fixedly secured to said perimeter portion of the associated facet by adhesive.

37. As an article of manufacture, a body for displaying indicia and/or visual images, said body comprising:

a) a first half-body portion;

b) a second half-body portion;

c) said first and second half-body portions joined over corresponding areas of said first and second half-body portions; and d) a half-circle and a quarter-circle flat facet on each of said first and second half-body portions on which indicia and/or visual images may be displayed.

38. The article of manufacture according to claim 37, wherein said quarter-circle flat facets are coincident in a common plane.

39. The article of manufacture according to claim 37, wherein said half-circle flat facets are coincident in planes that are perpendicular to one another.

40. The article of manufacture according to claim 37, wherein said quarter-circle facets are perpendicular to said half-circle facets.

41. The article of manufacture according to claim 37, wherein said first and second half-body portions each constitute a quarter-sphere having a quarter-spherical surface, and one half-circle and one quarter-circle facet perpendicular to one another.

42. The article of manufacture according to claim 37, wherein said indicia and/or visual image are borne by a support member, and means are provided on said half and quarter-circle facets for retaining thereon said support member bearing said indicia and/or visual images.

43. As an article of manufacture, a body having a multiplicity of facets arranged about the geometric center of the body for displaying indicia and/or visual images, said body comprising:

a) a first one-third body portion including a pair of flat quarter-circle facets;

b) a second one-third body portion including a pair of flat quarter-circle facets and integral with said first one-third body portion;

c) a third one-third body portion including a pair of flat quarter-circle facets and integral with said first and second one-third body portions; and d) a spherically arcuate surface connecting said quarter-circle facets of said first, second and third body portions.

44. The article of manufacture according to claim 43, wherein each quarter-circle facet of each of said first, second and third body portions is coincident with a corresponding facet on the opposite side of the geometric center and included in an adjacent body portion.

45. The article of manufacture according to claim 43, wherein each quarter-circle facet on each body portion is perpendicular to a quarter-circle facet on the adjacent body portions.

46. The article of manufacture according to claim 43, wherein said indicia and/or visual image are borne by a support member, and means are provided on said facets of said body portions for retaining thereon said support member bearing said indicia and/or visual image.

47. As an article of manufacture, a body having a multiplicity of flat facets arranged about a geometric center of the body for displaying indicia and/or visual images, said body comprising:

a) a first half-body portion;

b) a second half-body portion;

c) said first and second half-body portions joined integrally over corresponding areas of said first and second half-body portions; and d) a pair of quarter-circle flat facets and a less than quarter-circle facet on each of said first and second half-body portions on which indicia and/or visual images may be displayed.

48. The article of manufacture according to claim 47, wherein said first half-body portion is offset about said geometric center in relation to said second half-body portion in an amount corresponding to said less than quarter-circle facet.

49. The article of manufacture according to claim 47, wherein said less than quarter-circle facets on said first and second half-body portions are coincident in a common plane perpendicular to the planes in which said quarter-circle facets are included.

50. The article of manufacture according to claim 47, wherein said quarter-circle facets of each pair thereof diverge at an angle of ninety degrees.

51. The article of manufacture according to claim 47, wherein one of said two less-than-quarter-circle facets is included on the lower surface of said first half-body portion while the other less-than-quarter-circle facet is included on the upper surface of said second half-body portion.

52. The article of manufacture according to claim 51, wherein said two less than quarter-circle facets are included in a common plane and lie on opposite sides of the geometric center of said body.

53. The article of manufacture according to claim 47, wherein said indicia and/or visual image are borne by a support member, and means are provided on said facets of said first and second half-body portions for retaining thereon said support member bearing said indica and/or visual image.

54. As an article of manufacture, a body having multiplicity of flat facets arranged about a geometric center of the body for displaying indicia and/or visual images, said body comprising:

a) a first half-body portion;

b) a second half-body portion;

c) said first and second half-body portions joined integrally over corresponding areas of said first and second half-body portions;

d) a pair of quarter-circle flat facets on each of said first and second half-body portions; and e) a pair of less than quarter-circle flat facets on said second half-body portion.

55. The article of manufacture according to claim 54, wherein said facets of said pair of less than quarter-circle flat facets lie on opposite sides of said geometric center and in a common plane.

56. The article of manufacture according to claim 54, wherein each of said quarter-circle facets and each of said less than quarter-circle facets is generally triangular having edges convergent on an apex coincident with said geometric center of said body and a circularly arcuate edge opposite said geometric center and subtending said edges convergent on said geometric center.

57. The article of manufacture according to claim 54, wherein said pairs of quarter-circle facets include a diametrically extending edge coincident with said geometric center, the facets of said pair of facets included in said first half-body portion diverging from said diametrical edge at an angle less than ninety degrees while the facets of said pair of facets included in said second half-body portion diverge from said diametrical edge at an angle greater than ninety degrees.

58. The article of manufacture according to claim 54, wherein said first half-body portion is symmetrically disposed in relation to said second half-body portion, and said facets of said pair of less than quarter-circle facets lie on opposite sides of said first half-body portion.

59. The article of manufacture according to claim 54, wherein means are provided on at least one of said flat facets for retaining a support member bearing said indicia and/or visual images.

60. The article of manufacture according to claim 54, wherein said indicia and/or visual image are borne by a support member, and means are provided on said facets of said first and second half-body portions for retaining thereon said support member bearing said indicia and/or visual image.

* * * * *